United States Patent [19]

Hirao et al.

[11] Patent Number: 5,014,604

[45] Date of Patent: May 14, 1991

[54] PISTON FOR INTERNAL COMBUSTION ENGINE

[75] Inventors: Sumio Hirao; Masaji Matsunaga; Yoshihiro Yamada, all of Kanagawa, Japan

[73] Assignees: Nissan Motor Company, Limited; Atsugi Unisia Corporation, both of Japan

[21] Appl. No.: 421,106

[22] Filed: Oct. 13, 1989

[30] Foreign Application Priority Data

Oct. 14, 1988 [JP] Japan ..... 63-259030

[51] Int. Cl.[5] ..... F02F 3/00

[52] U.S. Cl. ..... 92/212; 123/193 P

[58] Field of Search ..... 123/193 P; 92/212, 213, 92/222, 231, 176

[56] References Cited

U.S. PATENT DOCUMENTS

| | | | |
|---|---|---|---|
| 4,120,081 | 10/1978 | Rosch et al. | 92/176 |
| 4,495,684 | 1/1985 | Sander et al. | 92/222 |
| 4,506,593 | 3/1985 | Sugiyama et al. | 92/212 |
| 4,590,901 | 5/1986 | Mizuhara | 92/212 |
| 4,648,308 | 3/1987 | Matsui et al. | 92/212 |
| 4,649,806 | 3/1987 | Hartsock | 92/212 |
| 4,742,759 | 5/1988 | Hayakawa | 92/212 |
| 4,746,582 | 5/1988 | Tsuno | 92/212 |
| 4,838,149 | 6/1989 | Donnison et al. | 92/222 |

*Primary Examiner*—Andrew M. Dolinar
*Assistant Examiner*—M. Macy
*Attorney, Agent, or Firm*—Lowe, Price, LeBlanc, Becker & Shur

[57] ABSTRACT

An internally-chilled piston for an internal combustion engine is provided. This piston comprises a piston body made of an aluminum alloy and a piston head including a cylindrical member and a ring-shaped member engaging the outer peripheral surface of the cylindrical member by a shrink fit bonding. The cylindrical member constitutes the central portion of the piston head, while the ring-shaped member constitutes the periphery thereof. On the surface of the ring-shaped member which contacts with the melt forming the piston body during casting, an aluminized layer is formed which chemically connects the ring-shaped member and the piston body to increase the mechanical strength of bonding therebetween.

16 Claims, 3 Drawing Sheets

PISTON FOR INTERNAL COMBUSTION ENGINE

BACKGROUND OF THE INvENTION

1. Technical Field of the Invention

The present invention relates generally to a piston for an internal combustion engine, and more particularly to a piston having improved mechanical strength.

2. Background of the Prior Art

As currently available high-powered internal combustion engines for automotive vehicles are developed, the thermal loads exerted on their engine pistons tend to increase. A piston has been accordingly proposed wherein a piston is internally chilled by the inclusion of a ceramic piston head plate during casting of the piston body to improve the heat resistance of the head plate of the piston which faces a combustion chamber of the engine.

However, there is a problem in that the internally chilled surface of the ceramic piston head is separate from the piston body, causing the ceramic piston head to play and to break due to shocks such as piston slap, since the ceramic piston head and the aluminum piston body do not bond well and the difference in thermal expansion therebetween is great. Additionally, the great difference in thermal expansion of the two materials tends to cause residual stress to be exerted on the piston body during cooling after casting. This results in cracking of the piston body.

SUMMARY OF THE INVENTION

It is accordingly an object of the present invention to provide a piston for an internal combustion engine which includes a piston body made of an aluminum alloy and a piston head made of a heat resistant alloy connected with the piston body firmly so as to provide a high mechanical strength of bonding therebetween to produce a high quality piston.

According to one aspect of the present invention, there is provided a piston for an internal combustion engine which comprises a piston head made of heat resistant material, a piston body made of an aluminum alloy, and an aluminized layer formed on a surface of said piston head and interfacing between said piston head and said piston body to connect said piston head with said piston body to improve the mechanical strength of the bond therebetween.

In the preferred embodiment, the piston head includes a first piston head member made of a ceramic and a second piston head member made of a titanium or a titanium alloy. The first head member constitutes the central portion of the piston head, while the second head member constitutes the periphery thereof, the second head member being engaged with the first head member by shrink fit bonding, the aluminized layer being formed on the surface of the second piston head member.

An elastic-plastic member may be further provided. This member is attached to an edge of the first piston head member to absorb stress due to differential thermal expansion between the piston body and the first piston head member during cooling after casting to prevent the piston body from cracking. Additionally, the edge of the first piston head member engaging the piston body may be chamfered to prevent the first head member from rotating relative to the piston body. Alternatively, a plurality of elastic-plastic members may be provided. In this case, the elastic-plastic members are attached to an edge of the first piston head member spaced apart from each other by given intervals to absorb stress due to differential thermal expansion between the piston body and the first piston head member during cooling after casting to prevent the piston body from cracking. A plurality of chamfered surfaces may be provided on the edge of the first piston head member between the elastic-plastic members to prevent the first piston head member from rotating relative to the piston body. It is preferable that the elastic-plastic member is an aluminum fiber molding.

The first piston head member may have a stepped portion on its outer peripheral surface. The second piston head member includes a hollow cylindrical portion into which the first piston head member is fitted and a flange portion on which the aluminized layer is formed. An edge of the hollow cylindrical portion engages the stepped portion so as to prevent the first piston head member from being separated from the piston body.

According to another aspect of the present invention, there is provided a piston for a diesel engine which comprises a piston body made of an aluminum alloy, a first piston head member made of a ceramic, the first piston head member being in the form of a cylinder, a second piston head member made of titanium or a titanium alloy, the second piston head member being approximately ring shaped and engaging the first piston head member by shrink fit bonding, and an aluminized layer formed on a surface of the second piston head member to connect the second piston head member with the piston body to improve the mechanical strength of the bond therebetween.

According to a further aspect of the invention, there is provided a method of producing a piston for an internal combustion engine which comprises the steps of providing a piston head including a first piston head member made of a ceramic and a second piston head member made of titanium or a titanium alloy, the first piston head member constituting a central portion of said piston head and the second piston head member constituting the periphery thereof, the second piston head member being engaged with the first piston head member by shrink fit bonding, the aluminized layer being formed on the surface of the second piston head member, forming an aluminized layer on a surface of said piston, disposing the piston head with the aluminized layer within a mold, pouring a melt of aluminum alloy for forming a piston body into the mold to be bonded to the aluminized layer to form a piston having improved mechanical strength of the bond therebetween.

DESCRIPTION OF THE PREFERRED EMBODIMENT

Figure 1:
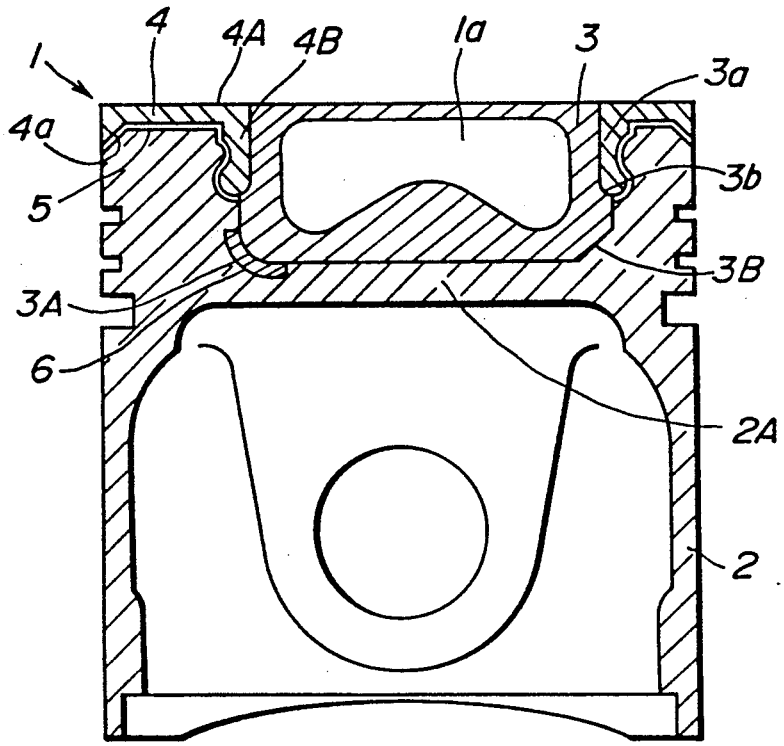
FIG. 1 is a sectional side view which shows a piston of a preferred embodiment according to the present invention.

Referring now to the drawings, wherein like numbers refer to like parts in the several views, particularly to FIG. 1, a piston for a diesel engine is shown as an embodiment according to the present invention. This piston 1 comprises generally a piston body 2 made of an aluminum alloy material and piston head including a hollow cylindrical head member 3 and a ring-shaped head member 4. The head member 3 is made of ceramic material and has a cavity 1*a* in its central portion.

The ceramic head member 3 is made from silicon nitride ($Si_3N_4$). The material of the head member 3 however may also be an oxide ceramic such as zirconia or aluminum titanate or a non-oxide ceramic such as silicon carbide (SiC) or sialon to obtain heat resistance sufficient for protecting the cavity against great thermal load due to combustion.

The ring-shaped head member 4 is made of titanium (Ti) or a titanium alloy and is engaged with the ceramic head member 3 by shrink fit bonding to form the piston head. However, as a bonding method between the titanium head member 4 and the ceramic head member 3, press fit bonding, heat resistant brazing, or solid-phase bonding may also be used. The titanium head member 4 is L-shaped in cross section including an upper disc plate 4A and an inner cylinder 4B. The ceramic head member 3 includes two sections having outer diameters different from each other. An annular stepped portion 3*b* is defined by the two sections which receive the lower edge portion of the inner cylinder 4B of the titanium head member to prevent the ceramic head member from being separated, or removed from the piston body 2. The small upper diameter section 3*a* is fitted into the inner wall of the titanium head member 4. It is preferable that the titanium head member 4 and the ceramic head member 3 are assembled by shrink fit bonding at a predetermined temperature in an inert gas.

On a surface which reaches from the lower surface of the upper disc portion 4A to the outer periphery of the inner cylinder 4B, an aluminized layer 5 is formed before casting wherein aluninum alloy is reacted at a predetermined high temperature. This aluminized layer 5 has a thickness of 15 to 20 (μm) for example and provides an improved mechanical strength of bonding between the titanium head member 4 and the piston body 2 during casting. Before aluminizing, the lower corner of the ceramic head member 3 is faced and fiber moldings 6 are attached thereon as will be describe hereinafter.

Figure 2:
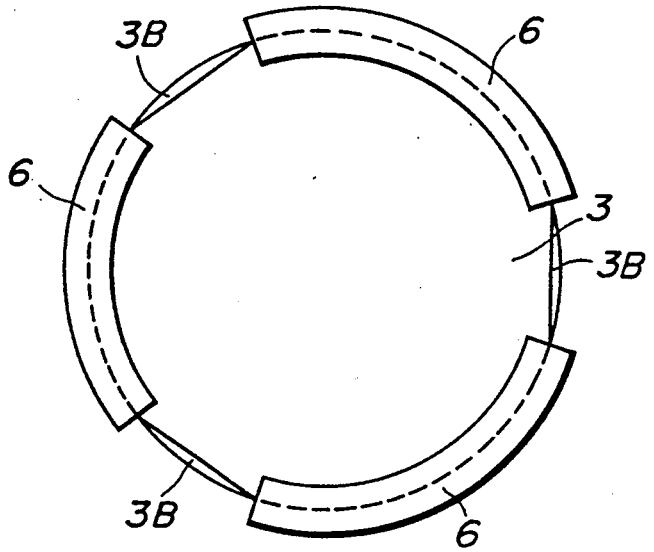
FIG. 2 is a bottom view which shows a ceramic piston head.

The lower edge 3A of the ceramic head member 3 is curved by a predetermined curvature. On this lower edge 3A, as shown in FIG. 2, three chamfered corners 3B are formed at regular intervals to prevent the ceramic head member from rotating relative the piston body 2 after casting.

Figure 3:
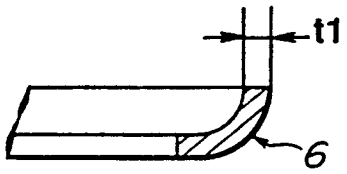
FIG. 3 is a side view which shows a fiber member for absorbing differential thermal expansion of a piston body and a ceramic head member during cooling after casting to reduce residual stress.

Bonded to the lower edge 3A by inorganic adhesive are alumina fiber moldings 6. These three fiber moldings are, as shown in FIG. 2, attached to the edges of tne piston head between the chamfered corners 3B. In this embodiment, three chamfered corners are provided, however a different number of chamfered corners may also be formed so as to be exposed between the fiber moldings. The fiber molding 6 is made of alumina fiber and is, as shown in FIG. 3, formed so as to be curved along the lower edge 3A of the ceramic head member 3 with a substantially constant thickness $t_1$.

For forming the piston 1, an assembly is first provided which is fabricated by fitting the ceramic head member 3 into the ring-shaped titanium head member 4 with a shrink fit bonding. The fiber moldings are attached to the edge of the ceramic head member. Subsequently, the aluminized layer is formed on the titanium head member 4. The assembly is pre-set within a mold for the piston body 2. Then, a melt for forming the piston body is poured into the mold to form the piston 1, i.e., by gravity casting. During casting, the titanium head member is chemically bonded firmly with the aluminum alloy forming the piston body. It is preferable that the fiber moldings 6 are formed with a predetermined porosity such as to prevent the melt from penetrating into it during casting thus providing all the more resiliency.

Therefore, since the titanium head member 4 has the necessary heat resistance against thermal load due to combustion and can provide a light-weight structure for the piston 1, a coefficient of thermal expansion of the head member 4 defined between those of the ceramic head member 3 and the aluminum alloy piston body 2 can be provided to restrict thermal stress occurring during engine operation.

In the aluminized layer 5 formed on the surface 4*a* between the titanium head member 4 and the piston body 2, the titanium alloy and the aluminum alloy are chemically connected to each other to provide high strength adhesion between the titanium head member 4 and the piston body 2 during solidifying when casting the piston body 2.

Figure 4:
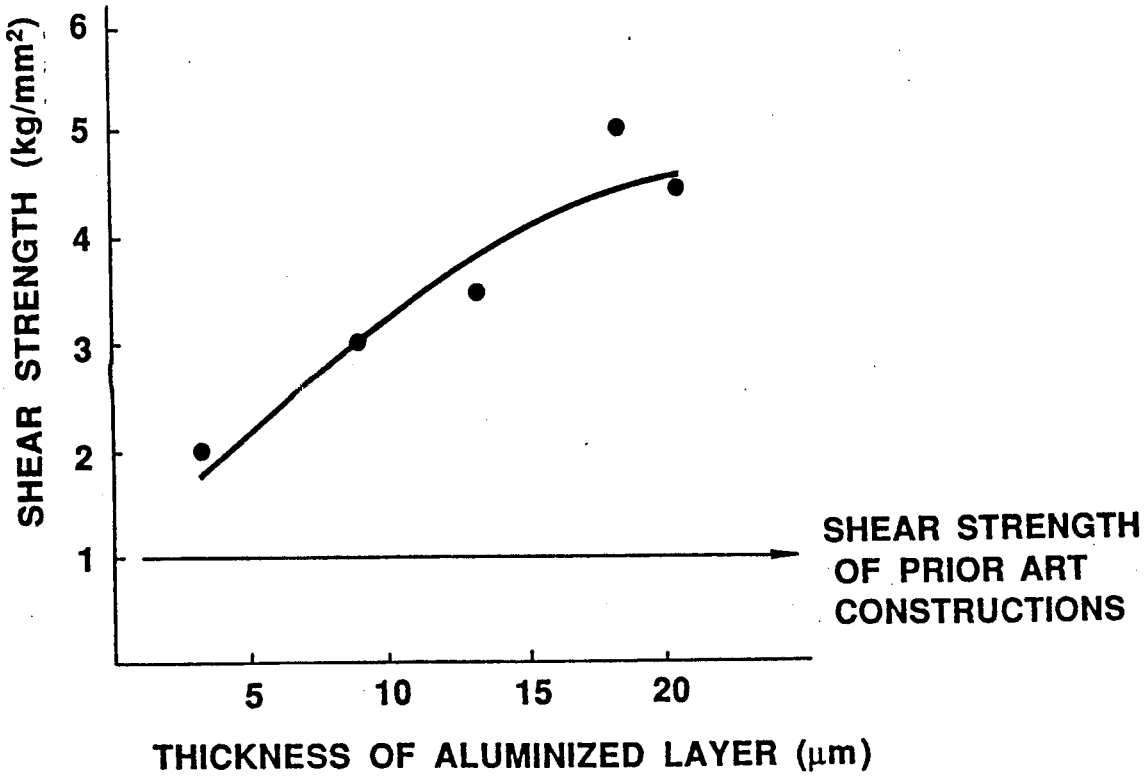
FIG. 4 is a graph which shows the shear strength of the bonding portion between a titanium alloy and an aluminum alloy relative to the thickness of the aluminized layer.

Referring to FIG. 4, test results are illustrated which show the shear strength of the bonding portion between the titanium alloy and the aluminum alloy relative to the thickness of the aluminized layer. The results show that an aluminized layer having a thickness of 15 through 20 (μm) can provide sufficient strength under the severe combustion requirements of an engine.

Figure 5:
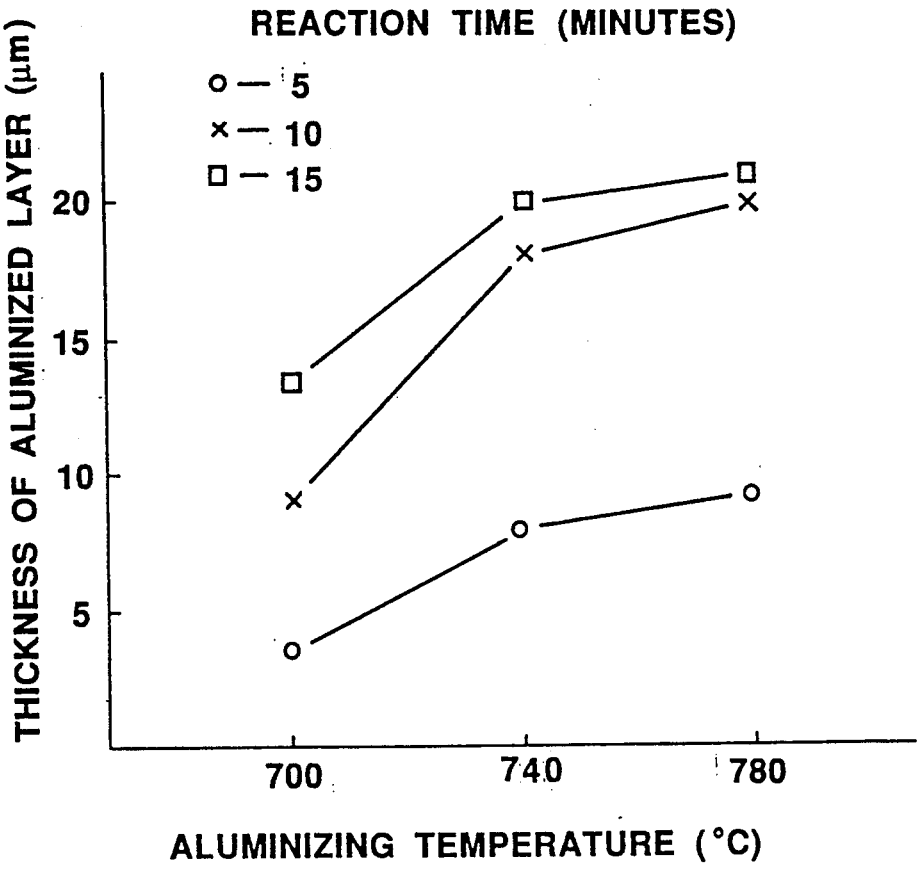
FIG. 5 is a graph which shows the time required for an aluminizing reaction relative to temperature and the thickness of the aluminized layer.

Referring to FIG. 5, test results are illustrated which show the thickness of the aluminized layer with respect to an aluminizing reaction time and the temperature therein. The results show that aluminizing wherein the treating temperature is 700 through 780 degrees C., and the reaction time is 10 to 15 minutes can provide an aluminized layer having a thickness of 15 through 20 (μm).

During aluminizing, since the thermal shock resistance of $Si_3N_4$, which is the material of the ceramic head member 3, is relatively low, pre-heating in a temperature range of 300 to 400 degrees C. between the aluminizing temperature and the ambient temperature is necessary.

As mentioned previously, the ceramic head member is prevented from being removed from the piston body 2 by the titanium head member 4 and further from rotating with respect to the piston body by the provision of chamfered corners 3B these measures provide mechanical strength sufficient against shock generated during engine operation.

The fiber moldings having impermeability against the melt are highly flexible and the stress due to differential thermal expansion between the ceramic head member 3 and the piston body 2 caused during cooling after casting is absorbed by elastic-plastic deformation of the fiber molding(s) 6, reducing residual stress occurring in the portion of the piston body 2 facing the lower edge 3A of the ceramic head member 3 to prevent cracking caused by tensile stress from occurring in the thin disc portion 2A of the piston body 2.

Figure 6:
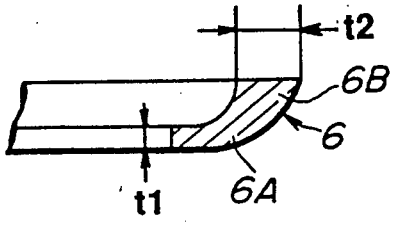
FIG. 6 is a sectional side view which shows a second embodiment of the fiber member of FIG. 3.

Referring to FIG. 6, a second embodiment of a fiber molding 6 is shown. The thickness $t_2$ of the side wall of this fiber molding 6 connecting with the side wall of the ceramic head member is 1.2 to 3 times the thickness $t_1$ of the bottom portion 6A connecting with the lower surface of the ceramic head member 3. This allows the fiber molding to be further elastically/plastically deformed, greatly reducing tensile stress affecting the thin disc portion 2A during cooling after the casting of the piston body 2.

As described above, according to the instant invention, a light-weight piston having higher thermal resistance and a higher mechanical strength can be provided. Further, the fiber molding can reduce stress acting on the piston body during cooling to prevent cracks from occurring. Thus, high quality can be obtained.

Although the invention has been shown and described with respect to a best mode embodiment thereof, the piston head including the ceramic head member 3 and the titanium head member 4 may be integrally formed of a heat resistant alloy such as a titanium alloy or a nickel base alloy. In this case, an aluminized layer is formed on the surface of the piston head connecting with the piston body. This piston head is put into a mold for the piston body and then an aluminum alloy is cast to form a piston having the necessary shape.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. A piston for an internal combustion engine, comprising:

a piston head made of heat resistant material;

a piston body made of an aluminum alloy; and an aluminized layer formed on a surface of said piston head and interfacing between said piston head and said piston body to connect said piston head with said piston body to improve the mechanical strength of the bond therebetween, wherein said piston head includes a first piston head member made of a ceramic and a second piston head member made of titanium or a titanium alloy, said first piston head member constituting a central portion of said piston head and said second piston head member constituting the periphery thereof, said second piston head member being engaged with said first piston head member by shrink fit bonding, said aluminized layer being formed on the surface of said second piston head member, and wherein the edge of said first piston head member engaging with said piston body is chamfered to prevent said first head member from rotating relative to said piston body.

2. A piston for an internal combustion engine, comprising:

a piston head made of heat resistant material, said piston head including a first piston head member made of a ceramic and a second piston head member made of titanium or a titanium alloy, said first piston head member constituting a central portion of said piston head and said second piston head member constituting the periphery thereof, said second piston head member being engaged with said first piston head member by shrink fit bonding, said aluminized layer being formed on the surface of said second piston head member;

a piston body made of an aluminum alloy;

an aluminized layer formed on a surface of said piston head and interfacing between said piston head and said piston body to connect said piston head with said piston body to improve the mechanical strength of the bond therebetween; and an elastic-plastic member attached to a curved edge of said first piston head member to absorb stress due to the differential thermal expansion between said piston body and said first piston head member during cooling in casting to prevent said piston body from cracking, wherein the edge of said first piston head member engaging with said piston body is chamfered to prevent said first piston head member from rotating relative to said piston body.

3. A piston for an internal combustion engine, comprising:

a piston head made of heat resistant material, said piston head including a first piston head member made of a ceramic and a second piston head member made of titanium or a titanium alloy, said first piston head member constituting a central portion of said piston head and said second piston head member constituting the periphery thereof, said second piston head member being engaged with said first piston head member by shrink fit bonding, said aluminized layer being formed on the surface of said second piston head member;

a piston body made of an aluminum alloy;

an aluminized layer formed on a surface of said piston head and interfacing between said piston head and said piston body to connect said piston head with said piston body to improve the mechanical strength of the bond therebetween; and a plurality of elastic-plastic members attached to an edge of said first piston head member spaced from each other by given intervals to absorb stress due to differential thermal expansion between said piston body and said first piston head member during cooling after casting to prevent said piston body from cracking and a plurality of chamfered surfaces provided on the edge of said first piston head member between said elastic-plastic members to prevent said first piston head member from rotating relative to said piston body.

4. A piston as set forth in claim 3, wherein:

said elastic-plastic member is an alumina fiber molding.

5. A piston for an internal combustion engine, comprising:

a piston head made of heat resistant material;

a piston body made of an aluminum alloy; and an aluminized layer formed on a surface of said piston head and interfacing between said piston head and said piston body to connect said piston head with said piston body to improve the mechanical strength of the bond therebetween, wherein said piston head includes a first piston head member made of a ceramic and a second piston head member made of titanium or a titanium alloy, said first piston head member constituting a central portion of said piston head and said second piston head member constituting the periphery thereof, said second piston head member being engaged with said first piston head member by shrink fit bonding, said aluminized layer being formed on the surface of said second piston head member, and wherein said first piston head member has a stepped portion on its outer peripheral surface, said second piston head member including a hollow cylindrical portion into which said first piston head member is fitted and a flange portion on which said aluminized layer is formed, an edge of said hollow cylindrical portion engaging said stepped portion so as to prevent said first piston head member from being separated from said piston body.

6. A piston for a diesel engine, comprising:

a piston body made of an aluminum alloy;

a first piston head member made of a ceramic, said first piston head member being in the form of a cylinder;

a second piston head member made of titanium or a titanium alloy, said second piston head member being approximately ring shaped and engaging said first piston head member by shrink fit bonding;

an aluminized layer formed on a surface of said second piston head member to connect said second piston head member with said piston body to improve the mechanical strength of the bond therebetween; and a plurality of elastic-plastic members attached to an edge of said first piston head member spaced from each other by given intervals to absorb stress due to differential thermal expansion between said piston body and said first piston head member during cooling after casting to prevent said piston body from cracking and a plurality of chamfered surfaces provided on the edge of said first piston head member between said elastic-plastic members to prevent said first piston head member from rotating relative to said piston body.

7. A piston for a diesel engine, comprising:

a piston body made of an aluminum alloy;

a first piston head member made of a ceramic, said first piston head member being in the form of a cylinder;

a second piston head member made of titanium or a titanium alloy, said second piston head member being approximately ring shaped and engaging said first piston head member by shrink fit bonding; and an aluminized layer formed on a surface of said second piston head member to connect said second piston head member with said piston body to improve the mechanical strength of the bond therebetween, wherein said first piston head member has a stepped portion on its outer peripheral surface, said second piston head member including a hollow cylindrical portion into which said first piston head member is fitted and a flange portion on which said aluminized layer is formed, an edge of said hollow cylindrical portion engaging said stepped portion so as to prevent said first piston head member from being separated from said piston body.

8. A method of producing a piston for an internal combustion engine, comprising the steps of:

providing a piston head including a first piston head member made of a ceramic and a second piston head member made of titanium or a titanium alloy, said first piston head member constituting a central portion of said piston head and said second piston head member constituting the periphery thereof, said second piston head member being attached to said first piston head member by shrink fit bonding and retaining means for restricting displacement of the first piston head member with respect to an axially upward direction of the piston;

forming an aluminized layer on a surface of said second piston head member interfacing with a piston body;

disposing said piston head with said aluminized layer within a mold; and pouring a melt of aluminum alloy for forming a piston body into the mold to be bonded to said aluminized layer to form a piston having improved mechanical strength of the bond between said piston body and said head.

9. A method as set forth in claim 8, wherein:

said retaining means is provided with a stepped portion formed on an outer peripheral surface of the first piston head member and an extending portion of the second piston head member engaging with the first piston head member.

10. A piston as set forth in claim 2, wherein:

the elastic-plastic member comprises a plurality of discrete elastic-plastic sections attached to the edge of said first piston head member spaced from each other by given intervals, the edges of said first piston head member between the elastic-plastic members being chamfered.

11. A piston for an internal combustion engine, comprising:

a piston body, made of aluminum alloy, having a cavity is a central end portion thereof;

a first piston head member made of ceramic, provided in the cavity of said piston body to define a central head portion;

a second piston head member made of titanium or a titanium alloy, defining the periphery of the piston head;

an aluminized layer formed on a surface of said second piston head member and interfacing between said piston body and second piston head member to connect said second piston head member to said piston body; and retaining means including parts of said first and second piston head members for retaining said first portion head member in the cavity of said piston body.

12. A piston as set forth in claim 11, wherein:

said retaining means is provided with a stepped portion formed on an outer peripheral surface of said first piston head member and an extending portion of said second piston head member engaging with the stepped portion.

13. A piston as set forth in claim 12, further comprising:

a plurality of elastic-plastic members attached to an edge of said first piston head member and spaced from each other by given intervals to absorb stress due to differential thermal expansion between said piston body and said first piston head member during cooling after casting of said piston body to prevent said piston body from cracking.

14. A method of producing a piston according to claim 8, comprising the further step of:

chamfering a portion of an edge of said first piston head member engaging with said piston body to prevent relative rotation therebetween.

15. A method of producing a piston according to claim 9, comprising the further step of:

attaching an elastic-plastic member to said edge of said first piston head member in selected relationship to said chamfered portion thereof before said disposing step.

16. A method of producing a piston according to claim 9, comprising the further step of:

chamfering a portion of an edge of said first piston head member engaging with said piston body to prevent relative rotation therebetween.

* * * * *